US009371504B2

(12) United States Patent
Hazenkamp et al.

(10) Patent No.: US 9,371,504 B2
(45) Date of Patent: Jun. 21, 2016

(54) USE OF ACRYLATE COPOLYMERS AS SOIL ANTIREDEPOSITION AGENTS AND SOIL RELEASE AGENTS IN LAUNDRY PROCESSES

(71) Applicants: BASF SE, Ludwigshafen (DE); Henkel AG & Co. KGAA, Düsseldorf (DE)

(72) Inventors: Menno Hazenkamp, Riehen (CH); Frank Oliver Heinrich Pirrung, Grünstadt (DE); Dario Perera, Basel (CH); Paula Barreleiro, Düsseldorf (DE); Christa Junkes, Düsseldorf (DE); Wolfgang von Rybinski, Düsseldorf (DE)

(73) Assignees: BASF SE (DE); HENKEL AG & Co. KGaA (DE)

( * ) Notice: Subject to any disclaimer, the term of this patent is extended or adjusted under 35 U.S.C. 154(b) by 0 days.

(21) Appl. No.: 14/353,985

(22) PCT Filed: Oct. 24, 2012

(86) PCT No.: PCT/EP2012/071018

§ 371 (c)(1),
(2) Date: Apr. 24, 2014

(87) PCT Pub. No.: WO2013/060706

PCT Pub. Date: May 2, 2013

(65) Prior Publication Data

US 2014/0287974 A1 Sep. 25, 2014

Related U.S. Application Data

(60) Provisional application No. 61/550,935, filed on Oct. 25, 2011.

(30) Foreign Application Priority Data

Oct. 25, 2011 (EP) ..... 11186445

(51) Int. Cl.

| | |
|---|---|
| ***C11D 1/00*** | (2006.01) |
| ***B08B 3/04*** | (2006.01) |
| ***C11D 3/00*** | (2006.01) |
| ***C11D 3/37*** | (2006.01) |
| ***C11D 11/00*** | (2006.01) |

(52) U.S. Cl.
CPC ..... *C11D 3/0036* (2013.01); *C11D 3/3776* (2013.01); *C11D 11/0017* (2013.01)

(58) Field of Classification Search
CPC ..... C11D 1/00; C11D 3/0036; C11D 3/3746; C11D 3/3757; C11D 3/3769; C11D 3/3776; B08B 3/04
See application file for complete search history.

(56) References Cited

U.S. PATENT DOCUMENTS

| | | | | |
|---|---|---|---|---|
| 6,451,756 | B2 | 9/2002 | Shulman et al. | |
| 2003/0186832 | A1 | 10/2003 | Padron et al. | |
| 2012/0015861 | A1 * | 1/2012 | Manna et al. | 510/361 |

FOREIGN PATENT DOCUMENTS

| | | | | |
|---|---|---|---|---|
| WO | WO-2008122517 | A2 | 0/2008 | |
| WO | WO 2008/122517 | * | 10/2008 | A61Q 17/04 |
| WO | WO-2008/122517 | A2 | 10/2008 | |
| WO | WO-2011/112944 | A1 | 9/2011 | |
| WO | WO-2011112944 | A1 | 9/2011 | |

OTHER PUBLICATIONS

International Search Report for PCT/EP2012/071018 dated Feb. 15, 2013.
International Search Report for PCT/EP2012/071018 mailed Feb. 15, 2013.

* cited by examiner

*Primary Examiner* — Brian P Mruk
(74) *Attorney, Agent, or Firm* — Drinker Biddle & Reath LLP

(57) ABSTRACT

The present invention relates to acrylate copolymers as soil antiredeposition agents and soil release agents in laundry processes. Further aspects of the invention are a method for preventing soil redeposition and for easier releasing soil from textiles in laundry processes and detergent formulations containing said acrylate copolymers.

19 Claims, No Drawings

USE OF ACRYLATE COPOLYMERS AS SOIL ANTIREDEPOSITION AGENTS AND SOIL RELEASE AGENTS IN LAUNDRY PROCESSES

CROSS-REFERENCE TO RELATED APPLICATIONS

This application is a national stage application (under 35 U.S.C. §371) of PCT/EP2012/071018, filed Oct. 24, 2012, which claims benefit of European Application No. 11186445.0, filed Oct. 25, 2011 and U.S. Provisional Application No. 61/550,935, filed Oct. 25, 2011, all of which are incorporated herein by reference in their entirely.

The present invention relates to acrylate copolymers as soil antiredeposition agents and soil release agents in laundry processes. Further aspects of the invention are a method for preventing soil redeposition and for easier releasing soil from textiles in laundry processes and detergent formulations containing said acrylate copolymers.

In customary household washing methods, soil may, after being released from the dirty textiles into the wash liquor, be again re-deposited on the textiles, especially when using suboptimal detergent formulations and/or at lower wash temperatures. A graying of the laundry becomes in this case apparent after multi-cycle washing. A further problem is that some types of soil and dirt are difficult to remove from textiles when using suboptimal detergent formulations and/or at lower wash temperatures, because these soils and dirt are strongly attached to the fiber surface or are strongly absorbed inside the fibers.

The use of several agents as soil antiredeposition agents and soil release agents in laundry processes is known. Examples are carboxymethyl cellulose or anionic derivatives of polymers from terephthalic acid and polyethylene glycol (see e.g. E. Smulders in "Laundry Detergents" Wiley-VCH Verlag GmbH, 2002, page 88). Soil antiredeposition agents may function by various mechanisms. Regarding soil release agents it is often assumed that these are deposited and accumulated on the fiber surface during laundry washing, thereby modifying the surface properties of the fibers. Soil and dirt that is subsequently deposited onto this modified fiber surface is easier released in a subsequent washing cycle.

The objective of the present invention is to provide an improved method, suitable for the household sector, by means of which soil redeposition can be prevented and soil and dirt can be easier released from textile fibers in laundry processes. A further object is to provide washing formulations suitable for that method.

It has now been found, surprisingly, that the mentioned objectives can be met to a great extent by the use of specific acrylate copolymers.

One aspect of the invention is the use of one or more acrylate copolymers as soil antiredeposition agents and soil release agents in aqueous laundry processes which are of formula (I)

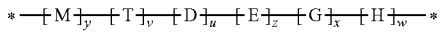

(I)

wherein u, v, w, x, y, and z represent the percentage by weight that each repeating unit or derived monomer is contained within the copolymer;

u, v, w, x, y, and z add up total 100 weight percent relative to the total weight of the copolymer;

y is from about 0 to about 40% by weight of the copolymer;

v is from about 5% to about 75% by weight of the copolymer;

u is from about 5% to about 80% by weight of the copolymer;

z is from about 0% to about 60% by weight of the copolymer;

x is from about 1% to about 50% by weight of the copolymer;

w is from about 0% to about 50% by weight of the copolymer;

* is a terminal group, for example, a catalyst residue;

M, T, D, E, G, and H are covalently bonded to each other;

M is derived from at least one monomer of formula (II)

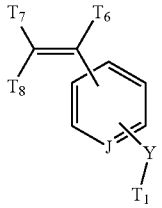

(II)

wherein $T_6$, $T_7$, and $T_8$ are $C_1$-$C_4$alkyl or hydrogen; Y is a direct bond, —O—, —S—, —N(H)— or —N($T_1$)-; $T_1$ is hydrogen or $C_1$-$C_4$alkyl; and J is a nitrogen or carbon atom;

T, D, and E are independently derived from at least one monomer of formula (III)

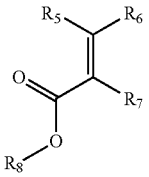

(III)

wherein $R_5$, $R_6$ and $R_7$ may be the same or different and represent hydrogen or $C_1$-$C_{22}$ alkyl;

$R_8$ is $C_1$-$C_{30}$ alkyl, $C_6$-$C_{15}$ cycloalkyl, or $C_6$-$C_{15}$ aryl; said substituted alkyl, said cycloalkyl or said aryl may also be substituted by one or more —OH and/or $NH_2$ groups; or said alkyl or said cycloalkyl may be interrupted by one or more —O— groups and/or —N(H)— groups; and w is greater than zero if alkyl or cycloalkyl are substituted by one or more —OH and/or $NH_2$ groups.

G is derived from at least one monomer comprising a heterocyclic group having at least one basic ring nitrogen atom or to which such a heterocyclic group is attached following polymerization;

H is derived from at least one monomer selected from the group consisting of toluene diisocyanate (all isomers), 4,4'-diphenylmethane diisocyanate, tolidine diisocyanate, dianisidine diisocyanate, m-xylylene diisocyanate, p-phenylene diisocyanate, m-phenylene diisocyanate, 1-chloro-2,4-phenylene diisocyanate, 3,3'-dimethyl-4,4'-bisphenylene diisocyanate, 4,4'-bis(2-methylisocyanatophenyl)methane, 4,4'-bisphenylene diisocyanate, 4,4'-bis(2-methoxyisocyanatophenyl)methane, 1-nitrophenyl-3,5-diisocyanate, 4,4'-diisocyanatodiphenyl ether, 3,3'-dichloro-4,4'-diisocyanatodiphenyl ether, 3,3'-dichloro-4,4'-diisocyanatodiphenyl methane, 4,4'-diisocyanatodibenzyl, 3,3'-dimethoxy-4,4'-diisocyanatodiphenyl, 2,2'-dimethyl-4,4'-diisocyanatodiphenyl, 2,2'-dichloro-5,5'-dimethoxy-4,4'-diisocyanatodiphenyl, 3,3'-dichloro-4,4'-diisocyanatodiphenyl, 1,2-naphthalene diisocyanate, 4-chloro-1,2-naphthalene diisocyanate, 4-methyl-1,2-naphthalene diisocyanate, 1,5-naphthalene diisocyanate, 1,6-naphthalene diisocyanate, 1,7-naphthalene diisocyanate, 1,8-naphthalene diisocyanate, 4-chloro-1,8-naphthalene diisocyanate, 2,3-naphthalene diisocyanate, 2,7-naphthalene diisocyanate, 1,8-dinitro-2,7-naphthalene diisocyanate, 1-methyl-2,4-naphthalene diisocyanate, 1-methyl-5,7-naphthalene diisocyanate, 6-methyl-1,3-naphthalene diisocyanate, 7-methyl-1,3-naphthalene diisocyanate, 1,2-ethane diisocyanate, 1,3-propane diisocyanate, 1,4-butane diisocyanate, 2-chloropropane-1,3-diisocyanate, pentamethylene diisocyanate, propylene-1,2-diisocyanate, 1,8-octane diisocyanate, 1,10-decane diisocyanate, 1,12-dodecane diisocyanate, 1,16-hexadecane diisocyanate 1,3- and 1,4-cyclohexane diisocyanate, 1,6-hexamethylene diisocyanate, 2,2,4- and 2,4,4-trimethylhexamethylene diisocyanate, diisocyanates or a mixture thereof dimer acid derived diisocyanate obtained from dimerized linoleic acid, 4,4'-dicyclohexylmethane diisocyanate, isophorone diisocyanate, 3-isocyanatomethyl-3,5,5-trimethylcyclohexyl diisocyanate, lysine methyl ester diisocyanate, bis(2-isocyanatoethyl)fumarate bis(2-isocyanatoethyl)carbonate, m-tetramethylxylylene diisocyanate, acrylonitrile and mixtures thereof;

with the proviso that T, D, and E are different from each other.

For the acrylate copolymers of formula (I), u+v+w+x+y+z=100 weight percent relative to the total weight of the copolymer.

The acrylate copolymers of formula (I) according to the instant invention are derived from at least three different monomers. Another aspect of the instant invention is the acrylate copolymers of formula (I) are derived from at least four different monomers.

For example M is derived from at least one monomer selected from the group consisting of styrene, alpha-methylstyrene, 2-vinyltoluene, 3-vinyltoluene, 4-vinyltoluene, ethylvinylbenzene and mixtures thereof.

For instance ID and E are independently derived from at least one monomer selected from the group consisting of methyl(meth)acrylate, ethyl(meth)acrylate, propyl(meth) acrylate, butyl(meth)acrylate, isobutyl(meth)acrylate, hexyl (meth)acrylate, cyclohexyl(meth)acrylate, 2-ethylhexyl (meth)acrylate, octyl(meth)acrylate, decyl(meth)acrylate, dodecyl(meth)acrylate, 2-ethyl hexyl(meth)acrylate, dimethyl aminoethyl(meth)acrylate, isobornyl(meth)acrylate, stearyl(meth)acrylate, behenyl(meth)acrylate, polypropylene glycol mono(meth)acrylate, glycidyl(meth)acrylate, polyethylene glycol mono(meth)acrylate, EO-PO-mono (meth)acrylate and mixtures thereof.

Typically G is selected from the group consisting of vinylimidazole, 2-vinylpyridine, 4-vinylpyridine, 2-methyl-N-vinylimidazole, vinylpyrrolidone, vinylcarbazole and mixtures thereof.

In a specific embodiment G is selected from the group consisting of 1-(2-hydroxyethyl)pyrrolidine, 2-(1-pyrrolidyl)-ethylamine, 2-(1-piperidyl)-ethylamine, 1-(2-hydroxyethyl)piperidine, 1-(2-aminopropyl)-piperidine. N-(2-hydroxyethyl)-hexamethylenimine, 4-(2-hydroxyethyl)-morpholine, 2-(4-morpholinyl)-ethylamine, 4-(3-aminopropyl)-morpholine, 1-(2-hydroxyethyl)-piperazine, 1-(2-aminoethyl)-piperazine, 1-(2-hydroxyethyl)-2-alkyl-imidazoline, 1-(3-aminopropyl)-imidazole, (2-aminoethyl)-pyridine, (2-hydroxyethyl)-pyridine, (3-hydroxypropyl)-pyridine, (hydroxymethyl)-pyridine, N-methyl-2-hydroxymethyl-piperidine, 1-(2-hydroxyethyl)-imidazole, 2-amino-6-methoxybenzothiazole, 4-aminomethyl-pyridine, 4-amino-2-methoxypyrimidine, 2-mercaptopyrimidine, 2-mercapto-benzimidazole, 3-mercapto-1,2,4-triazole, 3-amino-1,2,4-triazole, 2-isopropyl-imidazole, 2-ethyl-imidazole, 4-methyl-imidazole, 2-methyl-imidazole, 2-ethyl-4-methylimidazole, 2-phenyl-imidazole, 4-nitro-imidazole and mixtures thereof.

For example H is derived from at least one monomer selected from the group consisting of toluene diisocyanate, 4,4'-diphenylmethane diisocyanate, tolidine diisocyanate, m-xylylene diisocyanate, p-phenylene diisocyanate, m-phenylene diisocyanate, 1-chloro-2,4-phenylene diisocyanate, 3,3'-dimethyl-4,4'-bisphenylene diisocyanate, 4,4'-bisphenylene diisocyanate, 4,4'-bis(2-methoxyisocyanatophenyl) methane, 4,4'-diisocyanatodiphenyl ether, 4,4'-diisocyanatodibenzyl, 3,3'-dimethoxy-4,4'-diisocyanatodiphenyl, 2,2'-dimethyl-4,4'-diisocyanatodiphenyl, 2,2'-dichloro-5,5'-dimethoxy-4,4'-diisocyanatodiphenyl, 3,3'-dichloro-4,4'-diisocyanatodiphenyl, 1,3-propane diisocyanate, 1,4-butane diisocyanate, 2-chloropropane-1,3-diisocyanate, pentamethylene diisocyanate, propylene-1,2-diisocyanate, 1,8-octane diisocyanate, 1,10-decane diisocyanate, 1,12-dodecane diisocyanate, 1,16-hexadecane diisocyanate 1,3- and 1,4-cyclohexane diisocyanate, 1,6-hexamethylene diisocyanate, 2,2,4- and 2,4,4-trimethylhexamethylene diisocyanate, 4,4'-dicyclohexylmethane diisocyanate, isophorone diisocyanate, 3-isocyanatomethyl-3,5,5-trimethylcyclohexyl diisocyanate, lysine methyl ester diisocyanate, m-tetramethylxylylene diisocyanate and mixtures thereof.

Another embodiment of the instant invention for the compounds of formula (I) is that M is derived from at least one monomer of formula (II)

(II)

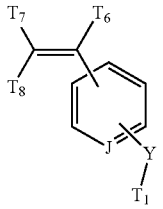

wherein $T_6$, $T_7$, and $T_5$ are methyl, ethyl or hydrogen; Y is a direct bond; $T_1$ is hydrogen or $C_1$-$C_4$ alkyl; and is a carbon atom.

Another embodiment of the instant invention for the compounds of formula (I) is that M is derived from at least one monomer of formula (II)

(II)

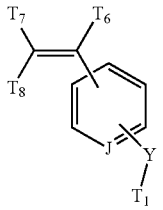

wherein $T_6$, $T_7$, and $T_8$ are methyl or hydrogen; Y is a direct bond; $T_1$ is hydrogen, methyl, or ethyl; and J is a carbon atom.

Another embodiment of the instant invention for the compounds of formula (I) is that M is derived from at least one monomer selected from the group consisting of styrene, alpha-methylstyrene, 2-vinyltoluene, 3-vinyltoluene, 4-vinyltoluene, ethylvinylbenzene and mixtures thereof.

Another embodiment of the instant invention for the compounds of formula (I) is T, D, and E are independently derived from at least one monomer of formula (III)

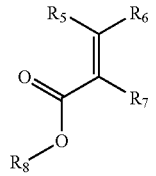

(III)

wherein $R_5$, $R_6$ and $R_7$ may be the same or different and represent hydrogen or $C_1$-$C_{12}$ alkyl;

$R_8$ is $C_1$-$C_{18}$ alkyl, or $C_6$-$C_{15}$ cycloalkyl; said substituted alkyl, or said cycloalkyl may also be substituted by one or more —OH and/or $NH_2$ groups; said alkyl or said cycloalkyl may be interrupted by one or more —O— groups and/or —N(H)— groups.

Another embodiment of the instant invention for the compounds of formula (I) is T, D, and E are independently derived from at least one monomer selected from the group consisting of methyl(meth)acrylate, ethyl(meth)acrylate, propyl(meth) acrylate, butyl(meth)acrylate, isobutyl(meth)acrylate, hexyl (meth)acrylate, cyclohexyl(meth)acrylate, 2-ethylhexyl (meth)acrylate, octyl(meth)acrylate, decyl(meth)acrylate, dodecyl(meth)acrylate, dimethyl aminoethyl(meth)acrylate, isobornyl(meth)acrylate, stearyl(meth)acrylate, behenyl (meth)acrylate, polypropylene glycol mono(meth)acrylate, glycidyl(meth)acrylate, polyethylene glycol mono(meth) acrylate, EO-PO-mono(meth)acrylate and mixtures thereof. The parentheses indicate that the monomers of formula (III) are esters based on either methacrylic acid or acrylic acid.

Another embodiment of the instant invention is acrylate copolymers of formula (I) that consist of a polymer chain having attached thereto a monomer derived from G containing heterocyclic groups with basic nitrogen atoms. Such a chain can be obtained either by polymerizing-in compounds containing both a vinyl and such a heterocyclic group, or by later attaching a heterocyclic group to the polymer chain containing corresponding reactive groups.

Preferred are heterocyclic groups with basic nitrogen groups having a pKa value of 2 to 14, more in particular 5 to 14 and most preferably 5 to 12. These pKa values relate to the measurement thereof at 25° C. in a 0.01 molar concentration in water. These basic groups impart to the acrylate copolymers according to the invention a basic character. These basic groups allow the acrylate copolymers to form organic and/or inorganic salts too. The acrylate copolymers can therefore be used in the form of such salts.

These salts are obtained by neutralization of the polymer with organic acids, e.g., aromatic acids having not more than 25 carbon atoms or aliphatic and cycloaliphatic acids having not more than 22 carbon atoms. Preference is given to salts of the polymer with organic monocarboxylic acids. Inorganic acids are, for example, hydrochloric acid, hydrobromic acid, sulphurous acid, sulphuric acid, and the like.

Suitable compounds of formula (I) G to be polymerized-in are selected from the group consisting of vinylimidazole, 2-vinylpyridine, 4-vinylpyridine, 2-methyl-N-vinylimidazole, vinylpyrrolidone, vinylcarbazole and mixtures thereof.

Suitable compounds containing at least one basic nitrogen atom and capable of being attached to a polymer chain of formula (I) G are described in, among others, EP-A-154,678.

Suitable compounds containing at least one basic nitrogen atom and capable of being attached to a polymer chain of formula (I) G are selected from the group consisting of 1-(2-hydroxyethyl)-pyrrolidine, 2-(1-pyrrolidyl)-ethylamine, 2-(1-piperidyl)-ethylamine, 1-(2-hydroxyethyl)-piperidine, 1-(2-aminopropyl)-piperidine, N-(2-hydroxyethyl)-hexamethylenimine, 4-(2-hydroxyethyl)-morpholine, 2-(4-morpholinyl)-ethylamine, 4-(3-aminopropyl)-morpholine, 1-(2-hydroxyethyl)-piperazine, 1-(2-aminoethyl)-piperazine, 1-(2-hydroxyethyl)-2-alkylimidazoline, 1-(3-aminopropyl)-imidazole, (2-aminoethyl)pyridine, (2-hydroxyethyl)-pyridine, (3-hydroxypropyl)-pyridine, (hydroxymethyl)pyridine, N-methyl-2-hydroxy-methyl-piperidine, 1-(2-hydroxyethyl)-imidazole, 2-amino-6-methoxybenzothiazole, 4-aminomethyl-pyridine, 4-amino-2-methoxypyrimidine, 2-mercaptopyrimidine, 2-mercapto-benzimidazole, 3-mercapto-1,2,4-triazole, 3-amino-1,2,4-triazole, 2-isopropyl-imidazole, 2-ethyl-imidazole, 4-methyl-imidazole, 2-methylimidazole, 2-ethyl-4-methyl-imidazole, 2-phenyl-imidazole, 4-nitroimidazole and mixtures thereof.

Another embodiment of the instant invention for the compounds of formula (I) H is derived from at least one monomer selected from the group consisting of toluene diisocyanate (all isomers), 4,4'-diphenylmethane diisocyanate, tolidine diisocyanate, dianisidine diisocyanate, m-xylylene diisocyanate, p-phenylene diisocyanate, m-phenylene diisocyanate, 1-chloro-2,4-phenylene diisocyanate, 3,3'-dimethyl-4,4'-bisphenylene diisocyanate, 4,4'-bisphenylene diisocyanate, 4,4'-bis(2-methoxyisocyanatophenyl)methane, 4,4'-diisocyanatodiphenyl ether, 3,3'-dichloro-4,4'-diisocyanatodiphenyl ether, 3,3'-dichloro-4,4'-diisocyanatodiphenyl methane, 4,4'-diisocyanatodibenzyl, 3,3'-dimethoxy-4,4'-diisocyanatodiphenyl, 2,2'-dimethyl-4,4'-diisocyanatodiphenyl, 2,2'-dichloro-5,5'-dimethoxy-4,4'-diisocyanatodiphenyl, 3,3'-dichloro-4,4'-diisocyanatodiphenyl, 1,2-ethane diisocyanate, 1,3-propane diisocyanate, 1,4-butane diisocyanate, 2-chloropropane-1,3-diisocyanate, pentamethylene diisocyanate, propylene-1,2-diisocyanate, 1,8-octane diisocyanate, 1,10-decane diisocyanate, 1,12-dodecane diisocyanate, 1,16-hexadecane diisocyanate 1,3- and 1,4-cyclohexane diisocyanate, 1,6-hexamethylene diisocyanate, 2,2,4- and 2,4,4-trimethylhexamethylene diisocyanate, diisocyanates or a mixture thereof dimer acid derived diisocyanate obtained from dimerized linoleic acid, 4,4'-dicyclohexylmethane diisocyanate, isophorone diisocyanate, 3-isocyanatomethyl-3,5,5-trimethylcyclohexyl diisocyanate, lysine methyl ester diisocyanate, m-tetramethylxylylene diisocyanate and mixtures thereof.

The acrylate copolymers of formula (I) according to the instant invention may be cross-linked by multifunctional monomers. These multifunctional monomers are selected from the group consisting of divinyl benzene, trivinylbenzene, divinyltoluene, divinylpyridine, divinylnaphthalene divinylxylene, ethyleneglycol di(meth)acrylate, trimethylolpropane tri(meth)acrylate, diethyleneglycol divinyl ether, trivinylcyclohexane, allyl(meth)acrylate, diethyleneglycol di(meth)acrylate, propyleneglycol di(meth)acrylate, 2,2-dimethylpropane-1,3-di(meth)acrylate, 1,3-butylene glycol di(meth)acrylate, 1,4-butanediol di(meth)acrylate, 1,6-hexanediol di(meth)acrylate, tripropylene glycol di(meth)acrylate, triethylene glycol di(meth)acrylate, tetraethylene glycol di(meth)acrylate, polyethylene glycol di(meth)acrylates, polyethylene glycol 200 di(meth)acrylate, polyethylene glycol 600 di(meth)acrylate, ethoxylated bisphenol A di(meth) acrylate, poly(butanediol) di(meth)acrylate, pentaerythritol tri(meth)acrylate, trimethylolpropane triethoxy tri(meth) acrylate, glyceryl propoxy tri(meth)acrylate, pentaerythritol tetra(meth)acrylate, dipentaerythritol monohydroxypenta (meth)acrylate, divinyl silane, trivinyl silane, dimethyl divinyl silane, divinyl methyl silane, methyl trivinyl silane, diphenyl divinyl silane, divinyl phenyl silane, trivinyl phenyl silane, divinyl methyl phenyl silane, tetravinyl silane, dimethyl vinyl disiloxane, poly(methyl vinyl siloxane), poly(vinyl hydro siloxane), poly(phenyl vinyl siloxane), and mixtures thereof.

Typically the indices x, y, z, u, v, w have the following meaning y is from about 0.1 to about 35% by weight of the copolymer of formula (I);

v is from about 5% to about 70% by weight of the copolymer of formula (I);

u is from about 5% to about 75% by weight of the copolymer of formula (I);

z is from about 0.1% to about 50% by weight of the copolymer of formula (I);

x is from about 1% to about 40% by weight of the copolymer of formula (I); and w is from about 0.1% to about 45% by weight of the copolymer of formula (I).

The weight-average molecular weight of the random copolymer of component (b) according to formula (I) exhibits a weight-average molecular weight of about 500 amu to about 1,000,000 atomic mass units (amu). In another aspect of the instant invention, the weight-average molecular weight of the random copolymer of component (b) formula (I) exhibits a weight-average molecular weight of about 500 amu to about 500,000 amu. In yet another aspect of the instant invention, the weight-average molecular weight of the random copolymer of component (b) formula (I) exhibits a weight-average molecular weight of about 500 amu to about 100,000 amu. In still another aspect of the instant invention, the weight-average molecular weight of the random copolymer of component (b) formula (I) exhibits a weight-average molecular weight of about 1000 amu to about 75,000 amu.

The acrylate copolymers are known and partially items of commerce. They are, for example, described in WO 08/122,517.

A particularly preferred random copolymer is that of example 13, described in WO 08/122,517. The copolymer is prepared by classical radical polymerisation.

For example the random copolymer of formula (I) has amphiphilic properties.

It is intended that the aqueous laundry process is a domestic laundry process.

For example the textile is made from polyester, polyacryl, cotton, wool, polyamide or mixtures thereof, preferably it is cotton.

Another aspect of the invention is a method for preventing soil redeposition on textiles and for soil release from textiles during an aqueous laundry process, which method comprises applying one or more acrylate copolymers as soil anti-redeposition agents and soil release agents in aqueous laundry processes which are of formula (I)

$$*-[M]_y-[T]_v-[D]_u-[E]_z-[G]_x-[H]_w-* \quad (I)$$

wherein u, v, w, x, y, and z represent the percentage by weight that each repeating unit or derived monomer is contained within the copolymer;

u, v, w, x, y, and z add up to total 100 weight percent relative to the total weight of the copolymer;

y is from about 0 to about 40% by weight of the copolymer;

v is from about 5% to about 75% by weight of the copolymer;

u is from about 5% to about 80% by weight of the copolymer;

z is from about 0% to about 60% by weight of the copolymer;

x is from about 1% to about 50% by weight of the copolymer;

w is from about 0% to about 50% by weight of the copolymer;

* is a terminal group, for example, a catalyst residue;

M, T, D, E, G, and H are covalently bonded to each other;

M is derived from at least one monomer of formula (II)

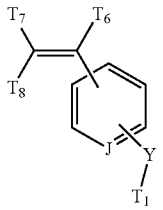

(II)

wherein $T_6$, $T_7$, and $T_8$ are $C_1$-$C_4$ alkyl or hydrogen; Y is a direct bond, —O—, —S—, —N(H)— or —N($T_1$)-; $T_1$ is hydrogen or $C_1$-$C_4$ alkyl; and J is a nitrogen or carbon atom;

T, D, and E are independently derived from at least one monomer of formula (III)

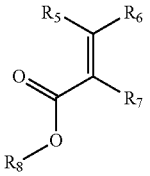

(III)

wherein $R_5$, $R_6$ and $R_7$ may be the same or different and represent hydrogen or $C_1$-$C_{22}$-alkyl;

$R_8$ is $C_1$-$C_{30}$ alkyl, $C_6$-$C_{15}$ cycloalkyl, or $C_6$-$C_{15}$ is aryl; said substituted alkyl, said cycloalkyl or said aryl may also be substituted by one or more —OH and/or $NH_2$ groups; or said alkyl or said cycloalkyl may be interrupted by one or more —O— groups and/or —N(H)— groups;

G is derived from at least one monomer comprising a heterocyclic group having at least one basic ring nitrogen atom or to which such a heterocyclic group is attached following polymerization;

H is derived from at least one monomer selected from the group consisting of toluene diisocyanate (all isomers), 4,4'-diphenylmethane diisocyanate, tolidine diisocyanate, dianisidine diisocyanate, m-xylylene diisocyanate, p-phenylene diisocyanate, m-phenylene diisocyanate, 1-chloro-2,4-phenylene diisocyanate, 3,3'-dimethyl-4,4'-bisphenylene diisocyanate, 4,4'-bis(2-methylisocyanatophenyl)methane, 4,4'-bisphenylene diisocyanate, 4,4'-bis(2-methoxyisocyanatophenyl)methane, 1-nitrophenyl-3,5-diisocyanate, 4,4'-diisocyanatodiphenyl ether, 3,3'-dichloro-4,4'-diisocyanatodiphenyl ether, 3,3'-dichloro-4,4'-diisocyanatodiphenyl methane, 4,4'-diisocyanatodibenzyl, 3,3'-dimethoxy-4,4'-diisocyanatodiphenyl, 2,2'-dimethyl-4,4'-diisocyanatodipheny, 2,2'-dichloro-5,5'-dimethoxy-4,4'-diisocyanatodiphenyl, 3,3'-dichloro-4,4'-diisocyanatodiphenyl, 1,2-naphthalene diisocyanate, 4-chloro-1,2-naphthalene diisocyanate, 4-methyl-1,2-naphthalene diisocyanate, 1,5-naphthalene diisocyanate, 1,6-naphthalene diisocyanate, 1,7-naphthalene diisocyanate, 1,8-naphthalene diisocyanate, 4-chloro-1,8-naphthalene diisocyanate, 2,3-naphthalene diisocyanate, 2,7-naphthalene diisocyanate, 1,8-dinitro-2,7-naphthalene diisocyanate, 1-methyl-2,4-naphthalene diisocyanate, 1-methyl-5,7-naphthalene diisocyanate, 6-methyl-1,3-naphthalene diisocyanate, 7-methyl-1,3-naphthalene diisocyanate, 1,2-ethane diisocyanate, 1,3-propane diisocyanate, 1,4-butane diisocyanate, 2-chloropropane-1,3-diisocyanate, pentamethylene diisocyanate, propylene-1,2-diisocyanate, 1,8-octane diisocyanate, 1,10-decane diisocyanate, 1,12-dodecane diisocyanate, 1,16-hexadecane diisocyanate 1,3- and 1,4-cyclohexane diisocyanate, 1,6-hexamethylene diisocyanate, 2,2,4- and 2,4,4-trimethylhexamethylene diisocyanate, diisocyanates or a mixture thereof dimer acid derived diisocyanate obtained from dimerized linoleic acid, 4,4'-dicyclohexylmethane diisocyanate, isophorone diisocyanate, 3-isocyanatomethyl-3,5,5-trimethylcyclohexyl diisocyanate, lysine methyl ester diisocyanate, bis(2-isocyanatoethyl)fumarate bis(2-isocyanatoethyl)carbonate, m-tetramethylxylylene diisocyanate, acrylonitrile and mixtures thereof; with the proviso that T, D, and E are different from each other.

When the random copolymer is used as part of a detergent it may be present in an amount of from 0.05 to 20% by weight based on the weight of the total detergent composition.

Further aspects of the invention are detergent compositions comprising:

I) from 1 to 50 wt-%, based on the total weight of the composition, A) of at least one surfactant;

II) from 0 to 70 wt-%, based on the total weight of the composition, B) of at least one builder substance;

III) from 0-30 wt-%, based on the total weight of the composition, C) of at least one peroxide and/or one peroxide-forming substance;

IV) from 0.05 to 10 wt.-%, preferably 0.05 to 5 wt %, more preferably 0.1 to 4 wt % based on the total weight of the composition, D) of at least one random copolymer as defined in claim 1;

V) from 0® 60 wt-%, based on the total weight of the composition, E) of at least one further additive;

VI) From 0-90 wt %, based on the total weight of the composition, F) water.

The composition according to the invention can be, for example, a solid peroxide-containing heavy-duty detergent, a detergent powder for delicate textiles, a laundry detergent powder for colored goods, or a structured (i.e. turbid) or unstructured (i.e. clear) water based liquid detergent.

Surfactants of Component A)

The detergent formulation will normally include at least one surfactant which may be anionic, cationic, nonionic or amphoteric.

The anionic surfactant can be, for example, a sulphate, sulphonate or carboxylate surfactant or a mixture thereof. Preference is given to alkylbenzenesulphonates, alkyl sulphates, alkyl ether sulphates, olefin sulphonates, fatty acid salts, alkyl and alkenyl ether carboxylates or to an α-sulphonic fatty acid salt or an ester thereof.

Preferred sulphonates are, for example, alkylbenzenesulphonates having from 10 to 20 carbon atoms in the alkyl radical, alkyl sulphates having from 8 to 18 carbon atoms in the alkyl radical, alkyl ether sulphates having from 8 to 18 carbon atoms in the alkyl radical, and fatty acid salts derived from palm oil or tallow and having from 8 to 18 carbon atoms in the alkyl moiety. The average molar number of ethylene oxide units added to the alkyl ether sulphates is from 1 to 20, preferably from 1 to 10. The cation in the anionic surfactants is preferably an alkaline metal cation, especially sodium or potassium, more especially sodium. Preferred carboxylates are alkali metal sarcosinates of formula $R_{19'}$—OON($R_{20'}$) $CH_2COOM_1$ wherein $R_{19'}$ is $C_9$-$C_{17}$alkyl or $C_9$-$C_{17}$alkenyl, $R_{20'}$ is $C_1$-$C_4$alkyl and $M_1$ is an alkali metal, especially sodium.

The non-ionic surfactant may be, for example, a primary or secondary alcohol ethoxylate, especially a $C_8$-$C_{20}$ aliphatic alcohol ethoxylated with an average of from 1 to 20 mol of ethylene oxide per alcohol group. Preference is given to primary and secondary $C_{10}$-$C_{15}$ aliphatic alcohols ethoxylated with an average of from 1 to 10 mol of ethylene oxide per alcohol group. Non-ethoxylated non-ionic surfactants, for example alkylpolyglycosides, glycerol monoethers and polyhydroxyamides (glucamide), may likewise be used.

In addition to anionic and/or non-ionic surfactants the composition may contain cationic surfactants. Possible cationic surfactants include all common cationic surface-active compounds, especially surfactants having a textile softening effect.

Non-limited examples of cationic surfactants are given in the formulas below:

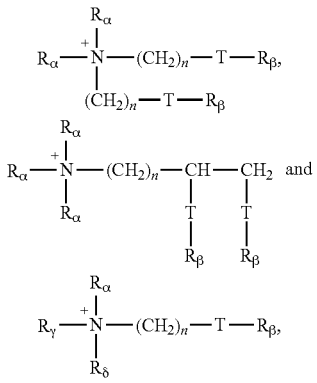

wherein each radical $R_\alpha$ is independent of the others $C_{1-6}$-alkyl-, -alkenyl- or -hydroxyalkyl; each radical $R_\beta$ is independent of the others $C_{8-28}$-alkyl- or alkenyl;

$R_\gamma$ is $R_\alpha$ or $(CH_2)_n$-T-$R_\beta$;

$R_\delta$ is $R_\alpha$ or $R_\beta$ or $(CH_2)_n$-T-$R_\beta$; T=—$CH_2$—, —O—CO— or —CO—O— and n is between 0 and 5.

Preferred cationic surfactants present in the composition according to the invention include hydroxyalkyl-trialkyl-ammonium-compounds, especially $C_{12}$-$C_{18}$-alkyl(hydroxyethyl)dimethylammonium compounds, and especially preferred the corresponding chloride salts.

Compositions of the present invention can contain between 0.5 wt-% and 15 wt-% of the cationic surfactant, based on the total weight of the composition.

The total amount of surfactants is preferably from 1 to 50 wt-%, especially from 1 to 40 wt-% and more especially from 1 to 30 wt-%.

Builder Substance B)

As builder substance B) there come into consideration, for example, alkali metal phosphates, especially tripolyphosphates, carbonates and hydrogen carbonates, especially their sodium salts, silicates, aluminum silicates, polycarboxylates, polycarboxylic acids, organic phosphonates, aminoalkylenepoly(alkylenephosphonates) and mixtures of such compounds.

Silicates that are especially suitable are sodium salts of crystalline layered silicates of the formula $NaHSi_tO_{2t+1}.pH_2O$ or $Na_2Si_tO_{2t+i}.pH_2O$ wherein t is a number from 1.9 to 4 and p is a number from 0 to 20.

Among the aluminum silicates, preference is given to those commercially available under the names zeolite A, B, X and HS, and also to mixtures comprising two or more of such components. Special preference is given to zeolite A.

Among the polycarboxylates, preference is given to polyhydroxycarboxylates, especially citrates, and acrylates, and also to copolymers thereof with maleic anhydride. Preferred polycarboxylic acids are nitrilotriacetic acid, ethylenediaminetetraacetic acid and ethylenediamine disuccinate either in racemic form or in the enantiomerically pure (S,S) form.

Phosphonates or aminoalkylenepoly(alkylenephosphonates) that are especially suitable are alkali metal salts of 1-hydroxyethane-1,1-diphosphonic acid, nitrilotris(methylenephosphonic acid), ethylenediaminetetramethylenephosphonic acid and diethylenetriaminepentamethylenephosphonic acid, and also salts thereof. Also preferred polyphosphonates have the following formula

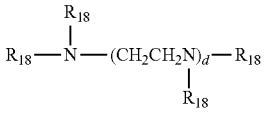

wherein $R_{18}$ is $CH_2PO_3H_2$ or a water soluble salt thereof and d is an integer of the value 0, 1, 2 or 3.

Especially preferred are the polyphosphonates wherein b is an integer of the value of 1.

Peroxide Component C)

As the peroxide component C) there come into consideration every compound which is capable of yielding hydrogen peroxide in aqueous solutions, for example, the organic and inorganic peroxides known in the literature and available commercially that bleach textile materials at conventional washing temperatures, for example at from 10 to 95° C. Preferably, however, inorganic peroxides are used, for example persulphates, perborates, percarbonates and/or persilicates.

All these peroxy compounds may be utilized alone or in conjunction with a peroxyacid bleach precursor and/or a bleach catalyst. Peroxy acids precursors are often referred to as bleach activators. Suitable bleach activators include the bleach activators, that carry O- and/or N-acyl groups and/or unsubstituted or substituted benzoyl groups. Preference is given to polyacylated alkylenediamines, especially tetraacetylethylenediamine (TAED); acylated glycolurils, especially tetraacetyl glycol urea (TAGU), N,N-diacetyl-N,N-dimethylurea (DDU); sodium-4-benzoyloxy benzene sulphonate (SBOBS); sodium-1-methyl-2-benzoyloxy benzene-4-sulphonate; sodium-4-methyl-3-benzol-sulphonyloxy benzoate; trimethyl ammonium toluoyloxy-benzene sulphonate; acylated triazine derivatives, especially 1,5-diacetyl-2,4-dioxohexahydro-1,3,5-triazine (DADHT); compounds of formula (6):

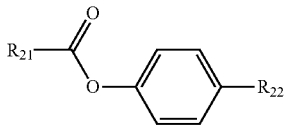

(10)

wherein $R_{22}$ is a sulphonate group, a carboxylic acid group or a carboxylate group, and wherein $R_{21}$ is linear or branched $(C_7\text{-}C_{15})$alkyl, especially activators known under the names SNOBS, SLOBS and DOBA; nitrile compounds that form perimine acids with peroxides also come into consideration as bleach activators. These bleach activators may be used in an amount of up to 12 wt-%, preferably from 2-10 wt-% based on the total weight of the composition.

It is also possible to use further bleach catalysts, which are commonly known, for example transition metal complexes as disclosed in EP 1194514, EP 1383857 or WO04/007657.

Further bleach catalysts are disclosed in: US2001044401, EP0458397, WO9606154, EP1038946, EP0900264, EP0909809, EP1001009, WO9965905, WO0248301, WO0060045, WO02077145, WO0185717, WO0164826, EP0923635, DE 19639603, DE102007017654, DE102007017657, DE102007017656, US20030060388, EP0918840B1, EP1174491A2, EP0805794B1, WO9707192A1, U.S. Pat. No. 6,235,695B1, EP0912690B1, EP832969B1, U.S. Pat. No. 6,479,450B1, WO9933947A1, WO0032731A1, WO03054128A1, DE102004003710, EP1083730, EP1148117, EP1445305, U.S. Pat. No. 6,476,996, EP0877078, EP0869171, EP0783035, EP0761809 and EP1520910.

The compositions may comprise, in addition to the combination according to the invention, one or more optical brighteners, for example from the classes bis-triazinylaminostilbenedisulphonic acid, bis-triazolyl-stilbenedisulphonic acid, bis-styryl-biphenyl or bis-benzofuranylbiphenyl, α bis-benzoxalyl derivative, bis-benzimidazolyl derivative or coumarin derivative or a pyrazoline derivative.

The compositions may furthermore comprise one or more further additives. Such additives are, for example, dirt-suspending agents, for example sodium carboxymethylcellulose; pH regulators, for example alkali metal or alkaline earth metal silicates; foam regulators, for example soap; salts for adjusting the spray drying and the granulating properties, for example sodium sulphate; perfumes; and also, if appropriate, antistatics and softening agents such as, for example, smectite; bleaching agents; pigments; and/or toning agents. These constituents should especially be stable to any bleaching agent employed.

If such auxiliaries are used they are added in a total amount of from 0.1-20 wt-%, preferably from 0.5-10 wt-%, especially from 0.5-5 wt-%, based on the total weight of the detergent formulation.

Furthermore, the detergent may optionally also comprise enzymes. Enzymes can be added for the purpose of stain removal. The enzymes usually improve the action on stains caused by protein or starch, such as, for example, blood, milk, grass or fruit juices. Preferred enzymes are cellulases and proteases, especially proteases. Cellulases are enzymes that react with cellulose and its derivatives and hydrolyse them to form glucose, cellobiose and cellooligosaccharides. Cellulases remove dirt and, in addition, have the effect of enhancing the soft handle of the fabric.

Examples of customary enzymes include, but are by no means limited to, the following:

proteases as described in U.S. Pat. No. 6,242,405, column 14, lines 21 to 32;

lipases as described in U.S. Pat. No. 6,242,405, column 14, lines 33 to 46;

amylases as described in U.S. Pat. No. 6,242,405, column 14, lines 47 to 56; and cellulases as described in U.S. Pat. No. 6,242,405, column 14, lines 57 to 64;

Commercially available detergent proteases, such as Alcalase®, Esperase®, Everlase®, Savinase®, Kannase® and Durazym®, are sold e.g. by NOVOZYMES A/S;

Commercially available detergent amylases, such as Termamyl®, Duramyl®, Stainzyme®, Natelase®, Ban® and Fungamyl®, are sold e.g. by NOVOZYMES A/S;

Commercially available detergent ellulases, such as Celluzyme®, Carezyme® and Endolase®, are sold e.g. by NOVOZYMES A/S;

Commercially available detergent lipases, such as Lipolase®, Lipolase Ultra® and Lipoprime®, are sold e.g. by NOVOZYMES A/S;

Suitable mannanases, such as Mannanaway®, are sold by NOVOZYMES A/S.

The enzymes, when used, may be present in a total amount of from 0.01 to 5 wt-%, especially from 0.05 to 5 wt-%, and more especially from 0.1 to 4 wt-%, based on the total weight of the detergent formulation.

Further preferred additives to the compositions according to the invention are dye-fixing agents and/or polymers which, during the washing of textiles, prevent staining caused by dyes in the washing liquor that have been released from the textiles under the washing conditions. Such polymers are preferably polyvinylpyrrolidones, polyvinylimidazoles or polyvinylpyridine-N-oxides, which may have been modified by the incorporation of anionic or cationic substituents, especially those having a molecular weight in the range of from 5000 to 60 000, more especially from 10 000 to 50 000. If such polymers are used, they are usually used in a total amount of from 0.01 to 5 wt-%, especially from 0.05 to 5 wt-%, more especially from 0.1 to 2 wt-%, based on the total weight of the detergent formulation. Preferred polymers are those mentioned in WO-A-02/02865 (see especially page 1, last paragraph and page 2, first paragraph) and those in WO-A-04/05688.

The compositions of the invention herein may also optionally contain one or more heavy metal chelating agents, such as hydroxyethyldiphosphonate (HEDP). More generally, chelating agents suitable for use herein can be selected from the group consisting of amino carboxylates, amino phosphonates, polyfunctionally-substituted aromatic chelating agents and mixtures thereof. Other suitable chelating agents for use herein are the commercial DEQUEST series, and chelants from Nalco, Inc.

Aminocarboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriamine-pentaacetates, and ethanoldiglycines, alkali metal, ammonium, and substituted ammonium salts thereof and mixtures thereof.

Aminophosphonates are also suitable for use as chelating agents in the compositions of the invention when at least low levels of total phosphorus are permitted in detergent compositions, and include ethylenediaminetetrakis(methylenephosphonates).

Further biodegradable sequestrants are, for example, aminoacid acetates, such as Trilon M (BASF) and Dissolvine GL (AKZO), as well as asparaginic acid derivatives, such as Baypure CX.

Preferably, the aminophosphonates do not contain alkyl or alkenyl groups with more than about 6 carbon atoms.

A highly preferred biodegradable chelator for use herein is ethylenediamine disuccinate ("EDDS").

If utilized, these chelating agents or transition-metal selective sequestrants will generally comprise from about 0.001 wt-% to about 10 wt-%, more preferably from about 0.05 wt-% to about 1 wt-% of the laundry detergent compositions herein.

Preferred compositions herein may additionally contain a dispersant polymer. When present, a dispersant polymer is typically at levels in the range from 0 wt-% to about 25 wt-%, preferably from about 0.5 wt-% to about 20 wt-%, more preferably from about 1 wt-% to about 8 wt-% of the detergent composition.

Suitable polymers are preferably at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1,000 to about 500,000, more preferably is from about 1,000 to about 250,000.

Unsaturated monomeric acids that can be polymerized to form suitable dispersant polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50 wt-% of the dispersant polymer.

Copolymers of acrylamide and acrylate having a molecular weight of from about 3,000 to about 100,000, preferably from about 4,000 to about 20,000, and an acrylamide content of less than about 50 wt-%, preferably less than about 20 wt-% of the dispersant polymer can also be used. Most preferably, such dispersant polymer has a molecular weight of from about 4,000 to about 20,000 and an acrylamide content of from about 0 wt-% to about 15 wt-%, based on the total weight of the polymer.

Particularly preferred dispersant polymers are low molecular weight modified polyacrylate copolymers. Such copolymers contain as monomer units: a) from about 90 wt-% to about 10 wt-%, preferably from about 80 wt-% to about 20 wt-% acrylic acid or its salts and b) from about 10 wt-% to about 90 wt-%, preferably from about 20 wt-% to about 80 wt-% of a substituted acrylic monomer or its salt and have the general formula: $—[(C(R_{a'})C(R_{b'})(C(O)OR_{c'})]$ wherein the apparently unfilled valencies are in fact occupied by hydrogen and at least one of the substituents $R_{a'}$, $R_{b'}$, or $R_{c'}$, preferably $R_{a'}$ or $R_{b'}$, is a 1 to 4 carbon alkyl or hydroxyalkyl group; $R_{a'}$ or $R_{b'}$ can be a hydrogen and $R_{c'}$ can be a hydrogen or alkali metal salt. Most preferred is a substituted acrylic monomer wherein $R_{a'}$ is methyl, $R_{b'}$ is hydrogen, and $R_{c'}$ is sodium.

A suitable low molecular weight polyacrylate dispersant polymer preferably has a molecular weight of less than about 15,000, preferably from about 500 to about 10,000, most preferably from about 1,000 to about 5,000. The most preferred polyacrylate copolymer for use herein has a molecular weight of about 3,500 and is the fully neutralized form of the polymer comprising about 70 wt-% acrylic acid and about 30 wt-% methacrylic acid.

Other dispersant polymers useful herein include the polyethylene glycols and polypropylene glycols having a molecular weight of from about 950 to about 30,000.

Other dispersant polymers useful herein include the cellulose sulphate esters such as cellulose acetate sulphate, cellulose sulphate, hydroxyethyl cellulose sulphate, methylcellulose sulphate, and hydroxypropylcellulose sulphate. Sodium cellulose sulphate is the most preferred polymer of this group.

Other suitable dispersant polymers are the carboxylated polysaccharides, particularly starches, celluloses and alginates.

Another group of acceptable dispersants are the organic dispersant polymers, such as polyaspartate.

Organic solvents that can be used in the cleaning formulations according to the invention, especially when the latter are in liquid or paste form, include alcohols having from 1 to 4 carbon atoms, especially methanol, ethanol, isopropanol and tert-butanol, diols having from 2 to 4 carbon atoms, especially ethylene glycol and propylene glycol, and mixtures thereof, and the ethers derivable from the mentioned classes of compound. Such water-miscible solvents are present in the cleaning formulations according to the invention preferably in amounts not exceeding 20 wt-%, especially in amounts of from 1 wt-% to 15 wt-%.

The detergent formulations can take a variety of physical forms such as, for example, powder granules, tablets (tabs), gel and liquid. Examples thereof include, inter alia, conventional high-performance detergent powders, supercompact high-performance detergent powders, conventional heavy duty liquid detergents, highly concentrated gels and tabs.

The detergent formulation may also be in the form of an aqueous liquid containing from 5 wt-% to 90 wt-%, preferably from 10 wt-% to 70 wt-%, of water or in the form of a non-aqueous liquid containing no more than 5 wt-%, preferably from 0 wt-% to 1 wt-% of water. Non-aqueous liquid detergent formulations may comprise other solvents as carriers. Low molecular weight primary or secondary alcohols, for example methanol, ethanol, propanol and isopropanol, are suitable for that purpose. The solubilising surfactant used is preferably a monohydroxy alcohol but polyols, such as those containing from 2 to 6 carbon atoms and from 2 to 6 hydroxy groups (e.g., 1,3-propanediol, ethylene glycol, glycerol and 1,2-propanediol) can also be used. Such carriers are usually used in a total amount of from 5 wt-% to 90 wt-%, preferably from 10 wt-% to 50 wt-%, based on the total weight of the detergent formulation. The detergent formulations can also used in so-called "unit liquid dose" form.

The definitions and preferences given above apply equally for all aspects of the invention.

THE FOLLOWING EXAMPLES ILLUSTRATE THE INVENTION

Random Copolymer

Compound D1, which is prepared according to example 13 of WO 08/122,517.

Application Results

Testing of the Anti-Redeposition Effect of the Copolymers of the Invention in Detergents.

A wash liquor is prepared containing water of 16° German hardness, a standard washing agent (AATCC 2003 Standard Liquid Reference Detergent WOB Order No. 08804) in a concentration of 4.7 g/l, soot (Corax N765) in a concentration of 0.03 g/L and optionally 0.075 g/L of one of the active polymers of the invention. The wash liquors are first stirred with a magnetic stirrer for 10 min, subsequently treated in a ultrasonic bath for 10 min. and finally again stirred for 10 min with a magnetic stirrer. Under stirring 100 g of the wash liquor is filled into a beaker of a Linitest apparatus, a cloth of 5 g white cotton fabric (WfK 13AK) is added. The beakers are closed and the white cotton is treated for 30 min at 40° C. in the wash liquor. Afterwards the textiles are rinsed under running tap water, spin dried and dried for 30 min at 45° C. This procedure is repeated 2 times (thus 3 wash cycles in total) with the same cotton cloth but with fresh wash liquor and fresh soot. Subsequently the CIE lightness Y of the cloths is measured with a DATA-COLOR Spectra Flash SF500 remission spectrometer.

The lightness Y of cotton cloths after the three wash cycles is a measure for the anti-redeposition performance of the wash liquor, containing the inventive copolymer. When the cloths are washed in the same manner but without adding soot, the cloths have a lightness Y of about 89.

The Y values for a polymer of the invention, compound D1 are shown in Table 1.

TABLE 1

Performance results in soil release test

| Polymer | Y(after) |
|---|---|
| No polymer (reference) | 67.4 |
| Sodium carboxymethylcellulose | 72.5 |
| D1 | 77.4 |

A significant increase in the lightness Y of the cotton cloths after three wash cycles is observed for the wash liquors containing a polymer of the invention. A significant improvement over sodium carboxymethylcellulose, the current state of the art, is observed.

The invention claimed is:

1. A composition comprising:

I) from 1 to 50 wt-%, based on the total weight of the composition, A) of at least one surfactant;

II) B), at least one builder substance, in an amount which does not exceed 70 wt-%;

III) from 0-30 wt-%, based on the total weight of the composition, C) of at least one peroxide and/or one peroxide-forming substance;

IV) from 0.05 to 10 wt.-% based on the total weight of the composition, D) of at least one acrylate copolymer of formula (I)

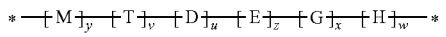

(I)

wherein u, v, w, x, y, and z represent the percentage by weight that each repeating unit or derived monomer is contained within the copolymer;

u, v, w, x, y, and z add up to total 100 weight percent relative to the total weight of the copolymer;

y is from 0.1 to about 40% by weight of the copolymer;

v is from about 5% to about 75% by weight of the copolymer;

u is from about 5% to about 80% by weight of the copolymer;

z is from 0.1 to 50% by weight of the copolymer;

x is from about 1% to about 50% by weight of the copolymer;

w is from 0% to about 50% by weight of the copolymer;

* is a terminal group;

M, T, D, E, G, and H are covalently bonded to each other;

M is derived from at least one monomer selected from the group consisting of styrene, alpha-methylstyrene, 2-vinyltoluene, 3-vinyltoluene, 4-vinyltoluene, ethylvinylbenzene and mixtures thereof;

T, D, and E are independently derived from at least one monomer selected from the group consisting of methyl (meth)acrylate, ethyl (meth)acrylate, propyl (meth) acrylate, butyl (meth)acrylate, isobutyl (meth)acrylate, hexyl (meth)acrylate, cyclohexyl (meth)acrylate, 2-ethylhexyl (meth)acrylate, octyl (meth)acrylate, decyl (meth)acrylate, dodecyl (meth)acrylate, dimethyl aminoethyl (meth)acrylate, isobornyl (meth)acrylate, stearyl (meth)acrylate, behenyl (meth)acrylate, polypropylene glycol mono(meth)acrylate, glycidyl (meth)acrylate, polyethylene glycol mono(meth)acrylate, EO-PO-mono(meth)acrylate and mixtures thereof G is derived from at least one monomer selected from the group consisting of vinylimidazole, 2-vinylpyridine, 4-vinylpyridine, 2-methyl-N-vinylimidazole, vinylpyrrolidone, vinylcarbazole and mixtures thereof; and H is derived from at least one monomer selected from the group consisting of toluene diisocyanate (all isomers), 4,4'-diphenylmethane diisocyanate, tolidine diisocyanate, dianisidine diisocyanate, m-xylylene diisocyanate, p-phenylene diisocyanate, m-phenylene diisocyanate, 1-chloro-2,4-phenylene diisocyanate, 3,3'-dimethyl-4,4'-bisphenylene diisocyanate, 4,4'-bis(2-methylisocyanatophenyl)methane, 4,4'-bisphenylene diisocyanate, 4,4'-bis(2-methoxyisocyanatophenyl)methane, 1-nitrophenyl-3,5-diisocyanate, 4,4'-diisocyanatodiphenyl ether, 3,3'-dichloro-4,4'-diisocyanatodiphenyl ether, 3,3'-dichloro-4,4'-diisocyanatodiphenyl methane, 4,4'-diisocyanatodibenzyl, 3,3'-dimethoxy-4,4'-diisocyanatodiphenyl, 2,2'-dimethyl-4,4'-diisocyanatodiphenyl, 2,2'-dichloro-5,5'-dimethoxy-4,4'-diisocyanatodiphenyl, 3,3'-dichloro-4,4'-diisocyanatodiphenyl, 1,2-naphthalene diisocyanate, 4-chloro-1,2-naphthalene diisocyanate, 4-methyl-1,2-naphthalene diisocyanate, 1,5-naphthalene diisocyanate, 1,6-naphthalene diisocyanate, 1,7-naphthalene diisocyanate, 1,8-naphthalene diisocyanate, 4-chloro-1,8-naphthalene diisocyanate, 2,3-naphthalene diisocyanate, 2,7-naphthalene diisocyanate, 1,8-dinitro-2,7-naphthalene diisocyanate, 1-methyl-2,4-naphthalene diisocyanate, 1-methyl-5,7-naphthalene diisocyanate, 6-methyl-1,3-naphthalene diisocyanate, 7-methyl-1,3-naphthalene diisocyanate, 1,2-ethane diisocyanate, 1,3-propane diisocyanate, 1,4-butane diisocyanate, 2-chloropropane-1,3-diisocyanate, pentamethylene diisocyanate, propylene-1,2-diisocyanate, 1,8-octane diisocyanate, 1,10-decane diisocyanate, 1,12-dodecane diisocyanate, 1,16-hexadecane diisocyanate 1,3- and 1,4-cyclohexane diisocyanate, 1,6-hexamethylene diisocyanate, 2,2,4- and 2,4,4-trimethylhexamethylene diisocyanate, thisocyanates or a mixture thereof dimer acid derived diisocyanate obtained from dimerized linoleic acid, 4,4'-dicyclohexylmethane diisocyanate, isophorone diisocyanate, 3-isocyanatomethyl-3,5,5-trimethylcyclohexyl diisocyanate, lysine methyl ester diisocyanate, bis(2-isocyanatoethyl)fumarate bis(2-isocyanatoethyl)carbonate, m-tetramethylxylylene diisocyanate, acrylonitrile and mixtures thereof;

with the proviso that T, D, and E are different from each other;

V) from 0-60 wt-%, based on the total weight of the composition, E) of at least one further additive;

VI) from 0-90 wt %, based on the total weight of the composition, F) water wherein the composition is a detergent composition for an aqueous laundry process.

2. The composition according to claim 1, wherein the compounds of formula (I) have a weight average molecular weight of from about 500 to about 1 million amu.

3. The composition according to claim 1, wherein random copolymer of formula (I) has amphiphilic properties.

4. The composition according to claim 1, wherein the aqueous laundry process is a domestic laundry process.

5. The composition according to claim 1, wherein the at least one acrylate copolymer of formula (I) is present in an amount of from 0.05 to 5 wt %.

6. The composition according to claim 1, wherein the at least one acrylate copolymer of formula (I) is present in an amount of from 0.1 to 4 wt %.

7. The composition according to claim 1, wherein the terminal group is a catalyst residue.

8. The composition according to claim 1, wherein:

y is from about 0.1 to about 35% by weight of the copolymer of formula (I);

v is from about 5% to about 70% by weight of the copolymer of formula (I);

u is from about 5% to about 75% by weight of the copolymer of formula (I);

z is from about 0.1% to about 50% by weight of the copolymer of formula (I);

x is from about 1% to about 40% by weight of the copolymer of formula (I); and w is from about 0.1% to about 45% by weight of the copolymer of formula (I).

9. The composition according to claim 1, wherein:

w is from 0.1% to about 50% by weight of the copolymer.

10. The composition according to claim 1, wherein:

M is derived from at least one monomer selected from the group consisting of 2-vinyltoluene, 3-vinyltoluene, 4-vinyltoluene, ethylvinylbenzene and mixtures thereof.

11. A composition consisting of:

I) from 1 to 50 wt-%, based on the total weight of the composition, A) of at least one surfactant;

II) from 0 to 70 wt-%, based on the total weight of the composition, B) of at least one builder substance;

III) from 0-30 wt-%, based on the total weight of the composition, C) of at least one peroxide and/or one peroxide-forming substance;

IV) from 0.05 to 10 wt.-% based on the total weight of the composition, D) of at least one acrylate copolymer of formula (I)

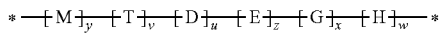

(I)

wherein u, v, w, x, y, and z represent the percentage by weight that each repeating unit or derived monomer is contained within the copolymer;

u, v, w, x, y, and z add up to total 100 weight percent relative to the total weight of the copolymer;

y is from 0.1 to about 40% by weight of the copolymer;

v is from about 5% to about 75% by weight of the copolymer;

u is from about 5% to about 80% by weight of the copolymer;

z is from 0.1 to 50% by weight of the copolymer;

x is from about 1% to about 50% by weight of the copolymer;

w is from 0% to about 50% by weight of the copolymer;

* is a terminal group;

M, T, D, E, G, and H are covalently bonded to each other;

M is derived from at least one monomer selected from the group consisting of styrene, alpha-methylstyrene, 2-vinyltoluene, 3-vinyltoluene, 4-vinyltoluene, ethylvinylbenzene and mixtures thereof;

T, D, and E are independently derived from at least one monomer selected from the group consisting of methyl (meth)acrylate, ethyl (meth)acrylate, propyl (meth) acrylate, butyl (meth)acrylate, isobutyl (meth)acrylate, hexyl (meth)acrylate, cyclohexyl (meth)acrylate, 2-ethylhexyl (meth)acrylate, octyl (meth)acrylate, decyl (meth)acrylate, dodecyl (meth)acrylate, dimethyl aminoethyl (meth)acrylate, isobornyl (meth)acrylate, stearyl (meth)acrylate, behenyl (meth)acrylate, polypropylene glycol mono(meth)acrylate, glycidyl (meth)acrylate, polyethylene glycol mono(meth)acrylate, EO-PO-mono(meth)acrylate and mixtures thereof G is derived from at least one monomer selected from the group consisting of vinylimidazole, 2-vinylpyridine, 4-vinylpyridine, 2-methyl-N-vinylimidazole, vinylpyrrolidone, vinylcarbazole and mixtures thereof; and H is derived from at least one monomer selected from the group consisting of toluene diisocyanate (all isomers), 4,4'-diphenylmethane diisocyanate, tolidine diisocyanate, dianisidine diisocyanate, m-xylylene diisocyanate, p-phenylene diisocyanate, m-phenylene diisocyanate, 1-chloro-2,4-phenylene diisocyanate, 3,3'-dimethyl-4,4'-bisphenylene diisocyanate, 4,4'-bis(2-methylisocyanatophenyl)methane, 4,4'-bisphenylene diisocyanate, 4,4'-bis(2-methoxyisocyanatophenyl)methane, 1-nitrophenyl-3,5-diisocyanate, 4,4'-diisocyanatodiphenyl ether, 3,3'-dichloro-4,4'-diisocyanatodiphenyl ether, 3,3'-dichloro-4,4'-diisocyanatodiphenyl methane, 4,4'-diisocyanatodibenzyl, 3,3'-dimethoxy-4,4'-diisocyanatodiphenyl, 2,2'-dimethyl-4,4'-diisocyanatodiphenyl, 2,2'-dichloro-5,5'-dimethoxy-4,4'-diisocyanatodiphenyl, 3,3'-dichloro-4,4'-diisocyanatodiphenyl, 1,2-naphthalene diisocyanate, 4-chloro-1,2-naphthalene diisocyanate, 4-methyl-1,2-naphthalene diisocyanate, 1,5-naphthalene diisocyanate, 1,6-naphthalene diisocyanate, 1,7-naphthalene diisocyanate, 1,8-naphthalene diisocyanate, 4-chloro-1,8-naphthalene diisocyanate, 2,3-naphthalene diisocyanate, 2,7-naphthalene diisocyanate, 1,8-dinitro-2,7-naphthalene diisocyanate, 1-methyl-2,4-naphthalene diisocyanate, 1-methyl-5,7-naphthalene diisocyanate, 6-methyl-1,3-naphthalene diisocyanate, 7-methyl-1,3-naphthalene diisocyanate, 1,2-ethane diisocyanate, 1,3-propane diisocyanate, 1,4-butane diisocyanate, 2-chloropropane-1,3-diisocyanate, pentamethylene diisocyanate, propylene-1,2-diisocyanate, 1,8-octane diisocyanate, 1,10-decane diisocyanate, 1,12-dodecane diisocyanate, 1,16-hexadecane diisocyanate 1,3- and 1,4-cyclohexane diisocyanate, 1,6-hexamethylene diisocyanate, 2,2,4- and 2,4,4-trimethylhexamethylene diisocyanate, diisocyanates or a mixture thereof dimer acid derived diisocyanate obtained from dimerized linoleic acid, 4,4'-dicyclohexylmethane diisocyanate, isophorone diisocyanate, 3-isocyanatomethyl-3,5,5-trimethylcyclohexyl diisocyanate, lysine methyl ester diisocyanate, bis(2-isocyanatoethyl)fumarate bis(2-isocyanatoethyl)carbonate, m-tetramethylxylylene diisocyanate, acrylonitrile and mixtures thereof;

with the proviso that T, D, and E are different from each other;

V) from 0-60 wt-%, based on the total weight of the composition, E) of at least one further additive;

VI) from 0-90 wt %, based on the total weight of the composition, F) water wherein the composition is a detergent composition for an aqueous laundry process.

12. A method for preventing soil redeposition on textiles and for soil release from textiles during an aqueous laundry process, which method comprises applying one or more acrylate copolymers as soil antiredeposition agents and soil release agents in aqueous laundry processes which are of formula (I)

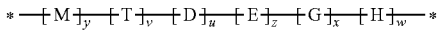

(I)

wherein u, v, w, x, y, and z represent the percentage by weight that each repeating unit or derived monomer is contained within the copolymer;

u, v, w, x, y, and z add up to total 100 weight percent relative to the total weight of the copolymer;

y is from 0.1 to about 40% by weight of the copolymer;

v is from about 5% to about 75% by weight of the copolymer;

u is from about 5% to about 80% by weight of the copolymer;

z is from 0.1 to 50% by weight of the copolymer;

x is from about 1% to about 50% by weight of the copolymer;

w is from 0% to about 50% by weight of the copolymer;

* is a terminal group;

M, T, D, E, G, and H are covalently bonded to each other;

M is derived from at least one monomer selected from the group consisting of styrene, alpha-methylstyrene, 2-vinyltoluene, 3-vinyltoluene, 4-vinyltoluene, ethylvinylbenzene and mixtures thereof;

T, D, and E are independently derived from at least one monomer selected from the group consisting of methyl (meth)acrylate, ethyl (meth)acrylate, propyl (meth) acrylate, butyl (meth)acrylate, isobutyl (meth)acrylate, hexyl (meth)acrylate, cyclohexyl (meth)acrylate, 2-ethylhexyl (meth)acrylate, octyl (meth)acrylate, decyl (meth)acrylate, dodecyl (meth)acrylate, dimethyl aminoethyl (meth)acrylate, isobornyl (meth)acrylate, stearyl (meth)acrylate, behenyl (meth)acrylate, polypropylene glycol mono(meth)acrylate, glycidyl (meth)acrylate, polyethylene glycol mono(meth)acrylate, EO-PO-mono(meth)acrylate and mixtures thereof G is derived from at least one monomer selected from the group consisting of vinylimidazole, 2-vinylpyridine, 4-vinylpyridine, 2-methyl-N-vinylimidazole, vinylpyrrolidone, vinylcarbazole and mixtures thereof; and H is derived from at least one monomer selected from the group consisting of toluene diisocyanate (all isomers), 4,4'-diphenylmethane diisocyanate, tolidine diisocyanate, dianisidine diisocyanate, m-xylylene diisocyanate, p-phenylene diisocyanate, m-phenylene diisocyanate, 1-chloro-2,4-phenylene diisocyanate, 3,3'-dimethyl-4,4'-bisphenylene diisocyanate, 4,4'-bis(2-methylisocyanatophenyl)methane, 4,4'-bisphenylene diisocyanate, 4,4'-bis(2-methoxyisocyanatophenyl)methane, 1-nitrophenyl-3,5-diisocyanate, 4,4'-diisocyanatodiphenyl ether, 3,3'-dichloro-4,4'-diisocyanatodiphenyl ether, 3,3'-dichloro-4,4'-diisocyanatodiphenyl methane, 4,4'-diisocyanatodibenzyl, 3,3'-dimethoxy-4,4'-diisocyanatodiphenyl, 2,2'-dimethyl-4,4'-diisocyanatodiphenyl, 2,2'-dichloro-5,5'-dimethoxy-4,4'-diisocyanatodiphenyl, 3,3'-dichloro-4,4'-diisocyanatodiphenyl, 1,2-naphthalene diisocyanate, 4-chloro-1,2-naphthalene diisocyanate, 4-methyl-1,2-naphthalene diisocyanate, 1,5-naphthalene diisocyanate, 1,6-naphthalene diisocyanate, 1,7-naphthalene diisocyanate, 1,8-naphthalene diisocyanate, 4-chloro-1,8-naphthalene diisocyanate, 2,3-naphthalene diisocyanate, 2,7-naphthalene diisocyanate, 1,8-dinitro-2,7-naphthalene diisocyanate, 1-methyl-2,4-naphthalene diisocyanate, 1-methyl-5,7-naphthalene diisocyanate, 6-methyl-1,3-naphthalene diisocyanate, 7-methyl-1,3-naphthalene diisocyanate, 1,2-ethane diisocyanate, 1,3-propane diisocyanate, 1,4-butane diisocyanate, 2-chloropropane-1,3-diisocyanate, pentamethylene diisocyanate, propylene-1,2-diisocyanate, 1,8-octane diisocyanate, 1,10-decane diisocyanate, 1,12-dodecane diisocyanate, 1,16-hexadecane diisocyanate 1,3- and 1,4-cyclohexane diisocyanate, 1,6-hexamethylene diisocyanate, 2,2,4- and 2,4,4-trimethylhexamethylene diisocyanate, diisocyanates or a mixture thereof dimer acid derived diisocyanate obtained from dimerized linoleic acid, 4,4'-dicyclohexylmethane diisocyanate, isophorone diisocyanate, 3-isocyanatomethyl-3,5,5-trimethylcyclohexyl diisocyanate, lysine methyl ester diisocyanate, bis(2-isocyanatoethyl)fumarate bis(2-isocyanatoethyl)carbonate, m-tetramethylxylylene diisocyanate, acrylonitrile and mixtures thereof; with the proviso that T, D, and E are different from each other.

13. The method according to claim 12, wherein the compounds of formula (I) have a weight average molecular weight of from about 500 to about 1 million amu.

14. The method according to claim 12, wherein random copolymer of formula (I) has amphiphilic properties.

15. The method according to claim 12, wherein the aqueous laundry process is a domestic laundry process.

16. The method according to claim 12, wherein the terminal group is a catalyst residue.

17. The method according to claim 12, wherein:

y is from about 0.1 to about 35% by weight of the copolymer of formula (I);

v is from about 5% to about 70% by weight of the copolymer of formula (I);

u is from about 5% to about 75% by weight of the copolymer of formula (I);

z is from about 0.1% to about 50% by weight of the copolymer of formula (I);

x is from about 1% to about 40% by weight of the copolymer of formula (I); and w is from about 0.1% to about 45% by weight of the copolymer of formula (I).

18. The method according to claim 12, wherein:

w is from 0.1% to about 50% by weight of the copolymer.

19. The method according to claim 12, wherein:

M is derived from at least one monomer selected from the group consisting of 2-vinyltoluene, 3-vinyltoluene, 4-vinyltoluene, ethylvinylbenzene and mixtures thereof.

* * * * *